US007496977B2

(12) United States Patent
Huei

(10) Patent No.: US 7,496,977 B2
(45) Date of Patent: Mar. 3, 2009

(54) TOILET TANK ACCESSORY RACK

(75) Inventor: Ouyang Huei, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 517 days.

(21) Appl. No.: 11/168,494

(22) Filed: Jun. 29, 2005

(65) Prior Publication Data

US 2007/0000044 A1 Jan. 4, 2007

(51) Int. Cl.
*E03D 1/00* (2006.01)

(52) U.S. Cl. ..... 4/661; 4/353; 211/90.03

(58) Field of Classification Search ..... 4/353, 4/661; 211/90.03, 133.5, 181.1
See application file for complete search history.

(56) References Cited

U.S. PATENT DOCUMENTS 2,797,816 A * 7/1957 Ross ..... 4/353 X
2,994,441 A * 8/1961 Browning, Jr. ..... 211/181.1 X
3,170,168 A * 2/1965 Cicatello ..... 4/353

* cited by examiner

*Primary Examiner*—Robert M Fetsuga
(74) *Attorney, Agent, or Firm*—Troxell Law Office, PLLC

(57) ABSTRACT

A toilet tank accessory rack has a fixing element and a holding element. The fixing element is assembled on a wall near a toilet tank of a toilet, and forms first assembling portions thereon. The holding element forms second assembling portions for corresponding to and locking with the first assembling portion. At least a storing chamber is provided on a side of the holding element for storing articles, such as shampoo, washing foam, books and magazines, where a user may conveniently fetch during defecating or washing.

10 Claims, 5 Drawing Sheets

TOILET TANK ACCESSORY RACK

BACKGROUND OF THE INVENTION

1. Field of the Invention

The present invention relates to a rack, and particularly to a toilet tank accessory rack which is assembled on a toilet tank of a toilet and holds articles for enlarging articles holding space of a bathroom.

2. Related Art

Toilets are always improved for making defecating and urinating more convenient. No matter earlier squat pans, seat style toilets, or trendy toilets which automatically flush, are all designed for facilitating defecating and urinating. Nowadays people are used to read newspapers or magazines during defecating. So it is popular to reserve newspapers or magazines in bathroom.

However, it is rarely to provide book shelf or specified place for storing newspapers or magazines in a small bathroom. Generally, people simply place the books, magazines, and newspapers on the cover of toilet tank where people can easily reach while sitting on the toilet. In this case, the bathroom appears untidy.

In prior art, some toilets provide articles holding room on a cover of the toilet tank thereof. For instance, such a design is illustrated in U.S. Pat. No. 5,862,536, as shown in FIG. 5. In U.S. Pat. No. 5,862,536, article holding room 80 is integrated with the tank 8 and is oriented at a rear thereof for reserving magazines and newspapers.

However, the article holding room 80 of U.S. Pat. No. 5,862,536 is disposed on rear of the user while sitting on the toilet. The user has to turn laterally and make his hand reversely to get magazines or books, thus it is inconvenient for the user and is contrary to ergonomic trend.

Moreover, the article holding room 80 of U.S. Pat. No. 5,862,536 is integrated with the tank 8, complicating assembly and usage for users and inapplicable for ordinary toilet tanks.

In addition, the article holding room 80 of U.S. Pat. No. 5,862,536 is bare, tending to remain dirt. Once liquid in a shampoo bottle pours, the article holding room 80 is uneasy to clean.

SUMMARY OF THE INVENTION

Accordingly, an object of the present invention is to provide a toilet tank accessory rack which is directly assembled on a toilet tank and stores articles, such as shampoo, washing foam, books and magazines, where a user may conveniently fetch during defecating or washing.

Another object of the present invention is to provide a toilet tank accessory rack which simplifies assembly/disassembly and facilitates cleaning.

The toilet tank accessory rack of the present invention comprises a fixing element and a holding element. The fixing element is assembled on a wall near a toilet tank of a toilet, and forms first assembling portions thereon. The holding element forms second assembling portions for corresponding to and locking with the first assembling portion. At least a storing chamber is provided on a side of the holding element for storing articles.

DESCRIPTION OF THE PREFERRED EMBODIMENTS

Figure 1:
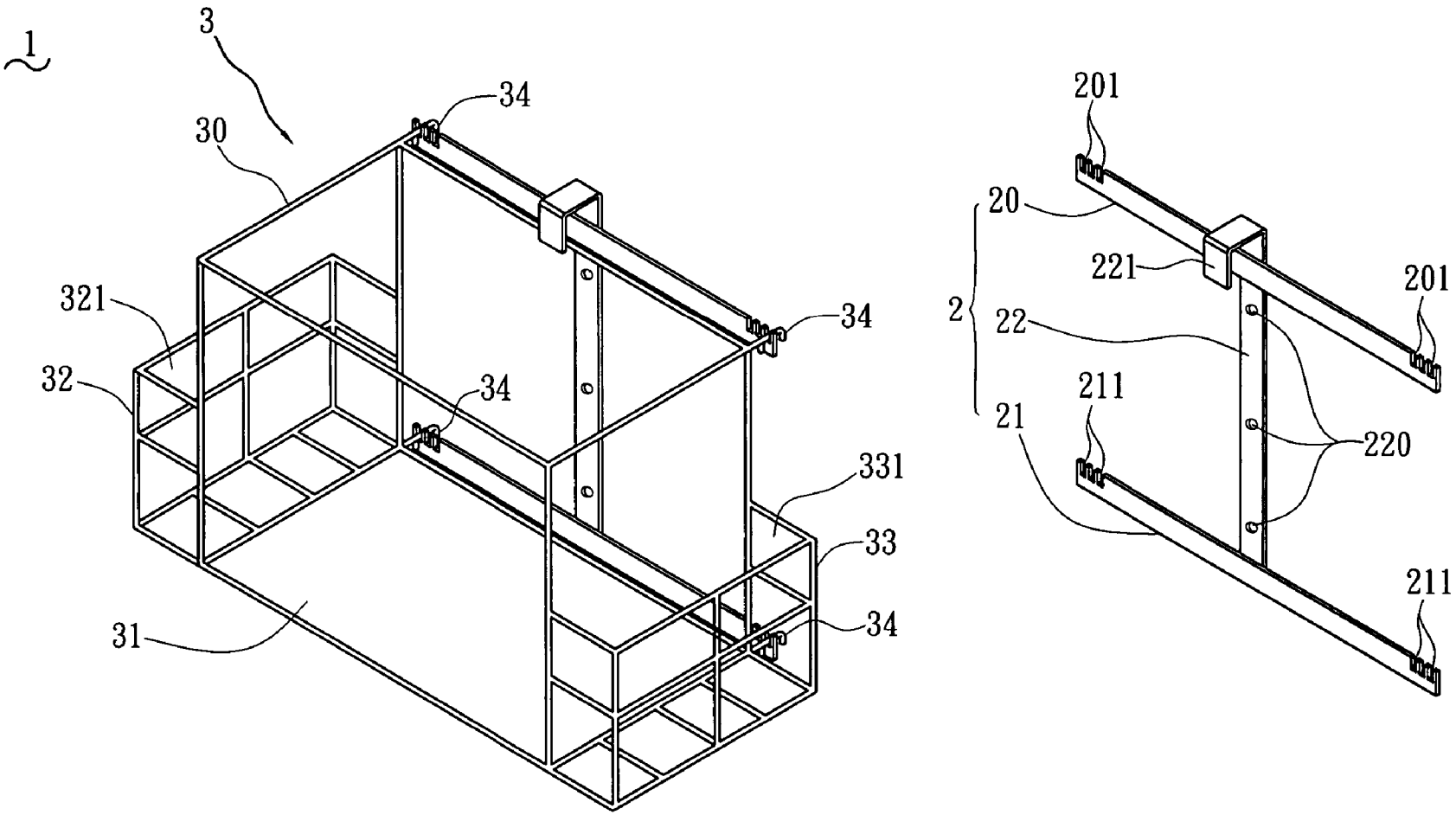
FIG. 1 is an exploded view of a toilet tank accessory rack according to the first embodiment of the present invention.
Figure 2:
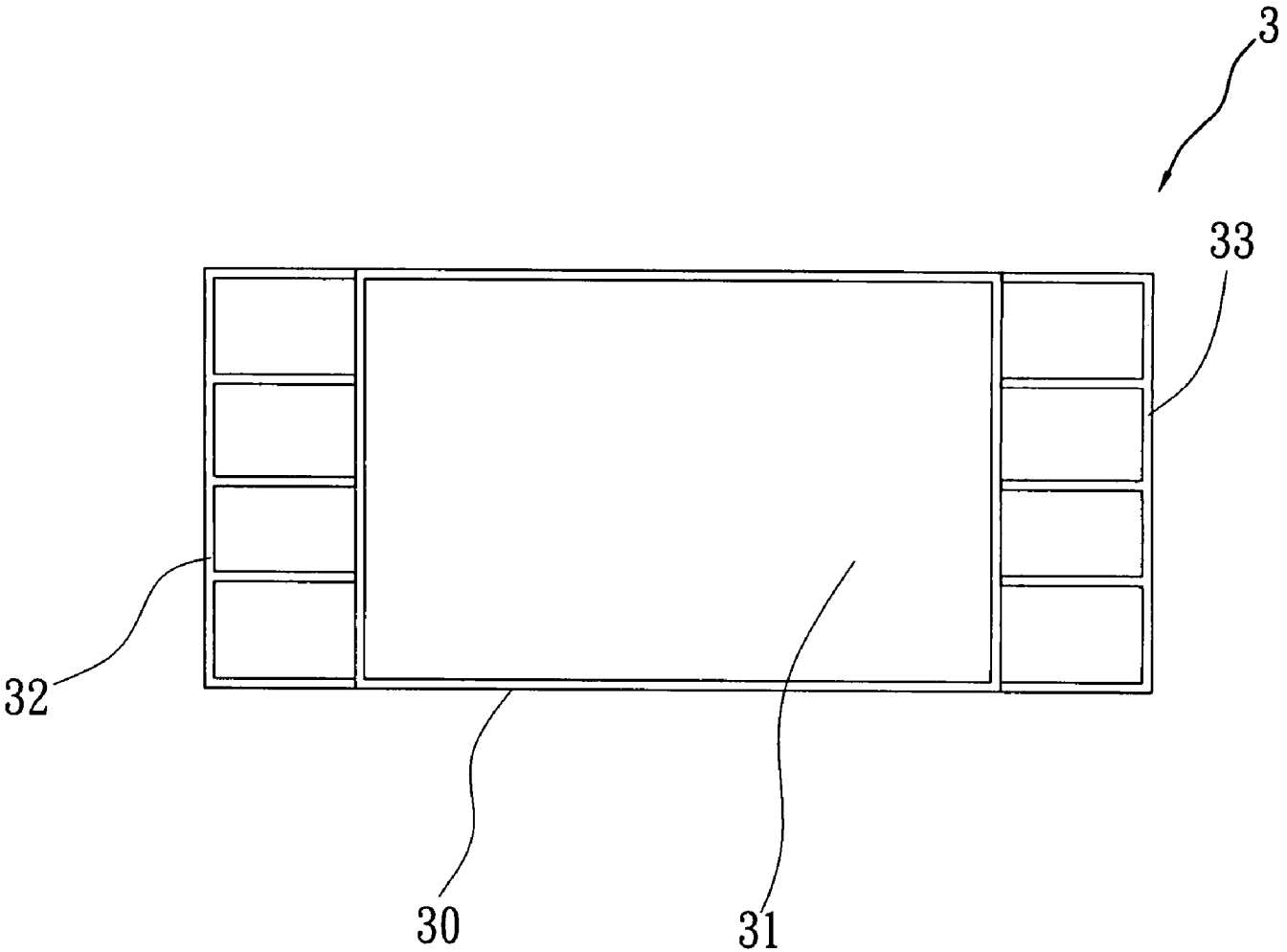
FIG. 2 is a plane view of FIG. 1.

With reference to FIGS. 1 and 2, a toilet tank accessory rack 1 in accordance with the first embodiment of the present invention comprises a fixing element 2 assembled on a wall near a toilet tank of a toilet and a holding element 3 assembled near the toilet tank. The fixing element 2 includes a pair of support plates 20, 21 horizontally opposing to each other. A connecting plate 22 connects the support plates 20, 21. A plurality of fixing holes 220 is defined in the connecting plate 22 for accommodating screws (not shown) to retain to a wall. The support plates 20, 21 respectively form first assembling portions for assembling onto the holding element 3. The first assembling portions comprise a plurality of positioning notches 201, 211 respectively defined in opposite ends of the support plates 20, 21. A hook 221 is formed on an end of the connecting plate 22 for locking an open side of the toilet tank.

As shown in FIG. 2, the holding element 3 includes a rectangular frame 30. A slot 31 is defined in the rectangular frame 30 for hitching the toilet tank. Storing chambers are disposed on opposite sides of the rectangular frame 30. The storing chambers are small rectangular rank portions 32, 33 which respectively and integrally extend from opposite sides of the rectangular frame 30. The small rectangular rank portions 32, 33 respectively define upward openings 321, 331 for storing articles, such as shampoo, washing foam, books and magazines. Second assembling portions are formed on the rectangular frame 30 for corresponding to and locking with the first assembling portion of the fixing element 2. The second assembling portions comprise inverted-L shaped clasps 34 extending from the rectangular frame 30 for anchoring the positioning notches 201, 211. Notably, the positioning notches 201, 211 and the inverted-L shaped clasps 34 are arranged to be compliant to toilet tanks of different types.

Figure 3:
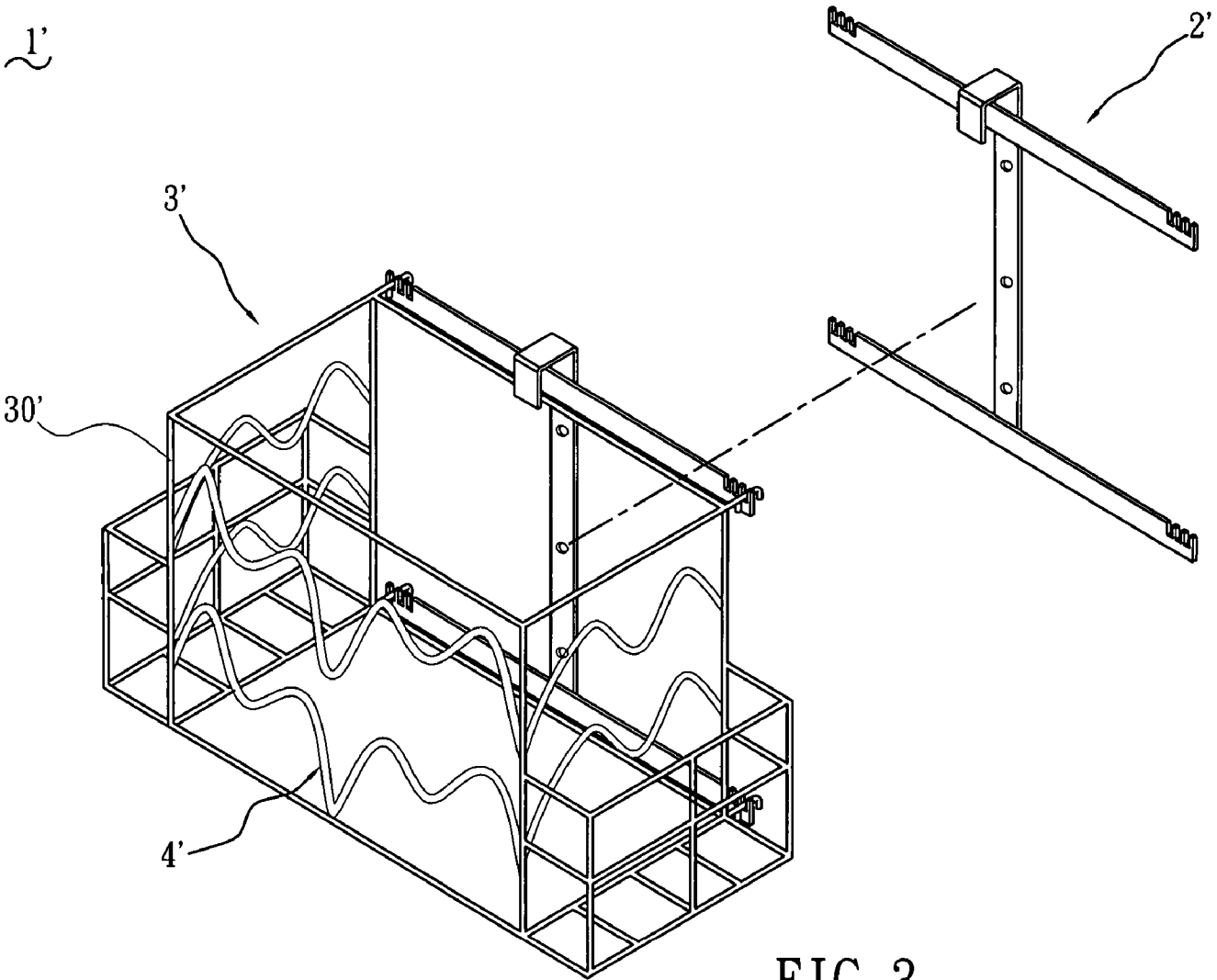
FIG. 3 is an exploded view of a toilet tank accessory rack according to the second embodiment of the present invention.

Referring to FIG. 3, a toilet tank accessory rack 1' in accordance with the second embodiment of the present invention comprises a fixing element 2' and a holding element 3'. The second embodiment is similar to the first embodiment except that art pictures 4' are provided on the rectangular frame 30' of the holding element 3' and correspond to a front and lateral sides of the toilet tank. The art pictures 4' may be all kinds of flower patterns and animal pictures.

Figure 4:
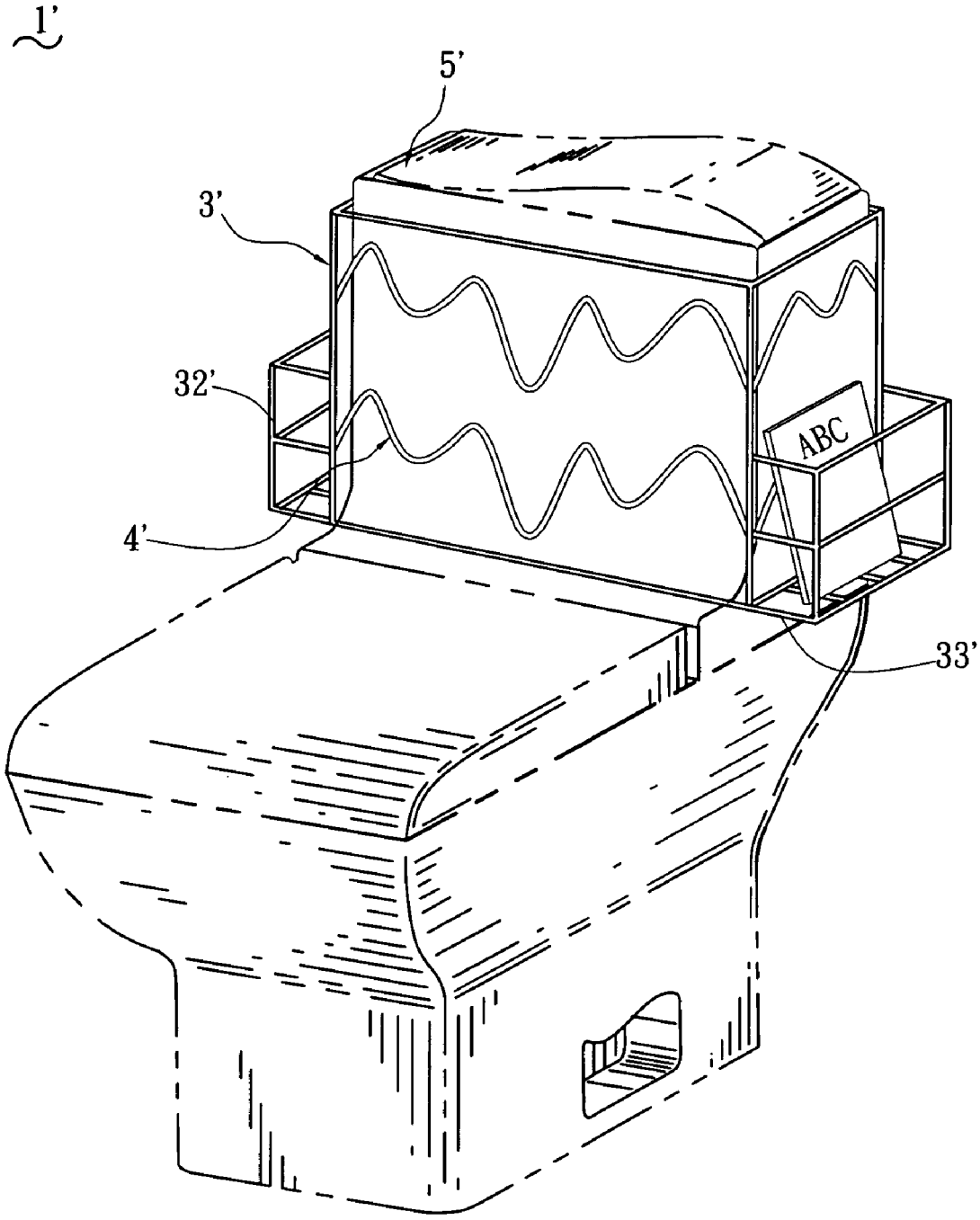
FIG. 4 is a perspective view of the toilet tank accessory rack of FIG. 3 assembled on a toilet.
Figure 5:
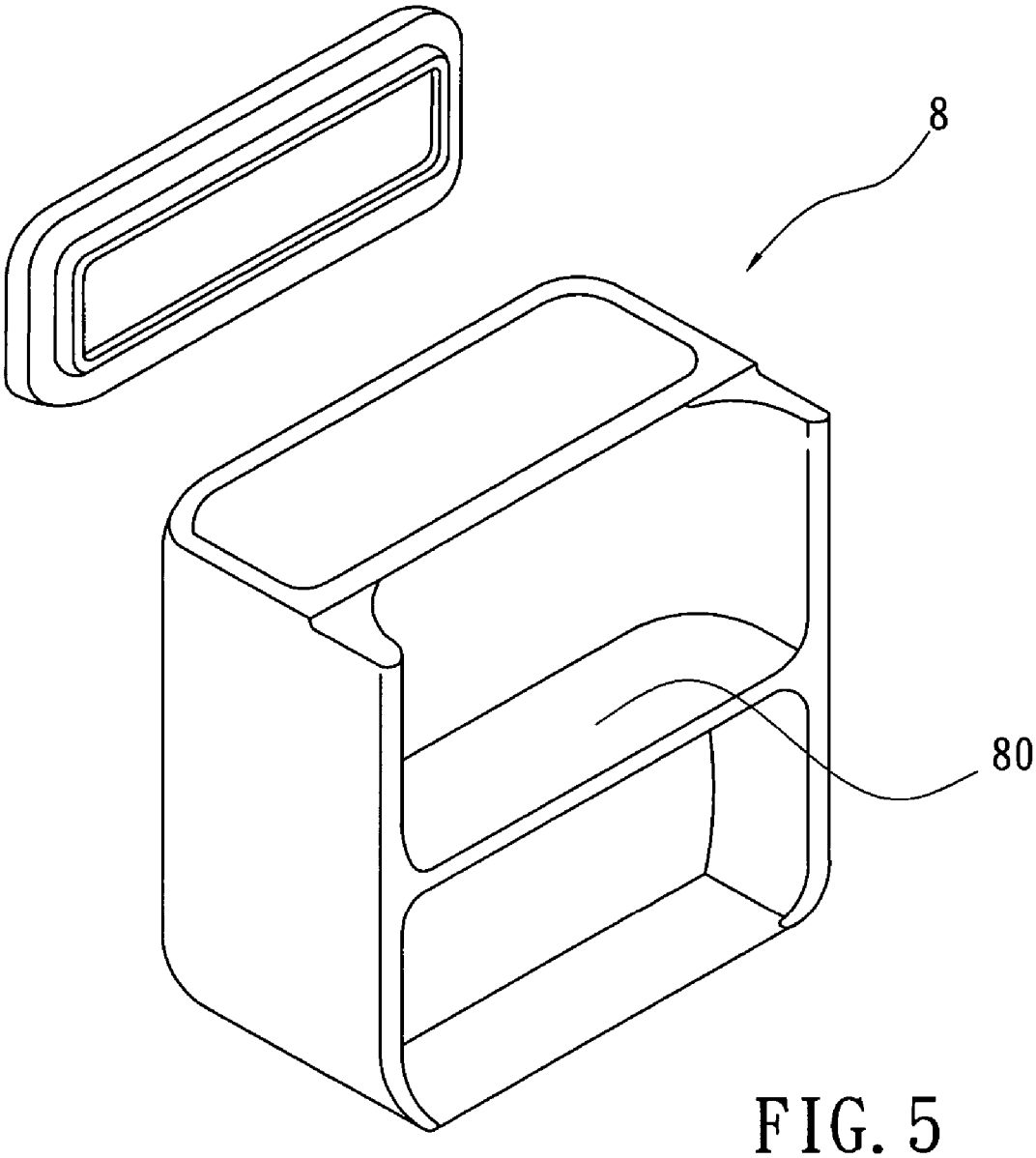
FIG. 5 is a schematic view of a toilet in U.S. Pat. No. 5,862,536.

As shown in FIG. 4, the toilet tank accessory rack 1' of the second embodiment is mounted on a toilet 5'. FIG. 4 clearly shows that small rectangular rank portions 32', 33' are arranged on opposite sides of the holding element 3' for storing articles, such as shampoo, washing foam, books and magazines. FIG. 4 also shows that the holding element 3' is preferably formed to be located on all four sides of the tank of the toilet 5'. The toilet tank accessory rack is separate relative to the toilet and may be easily assembled on different toilet tanks. Therefore, the toilet tank accessory rack of the present invention can be employed extensively. On the other hand, the toilet tank accessory rack is separate relative to the toilet and may be easily disassembled for cleaning.

In addition, the art pictures 4' on front and lateral sides of the holding element 3' raise aesthetic feeling and decorate the bathroom, which further improve utility of the present invention.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. A toilet tank accessory rack for a toilet tank located adjacent to a wall comprising:

a fixing element configured to be connected to the wall; and a holding element connected to the fixing element and having at least one storing chamber, the holding element is configured to be located on four sides of the toilet tank, the at least one storing chamber is located on a side of the holding element, wherein the fixing element has two support plates and a connecting plate, the two support plates are spaced apart and located in horizontal positions, each of the two support plates has a middle portion connected to the connecting plate and a plurality of positioning notches located at each of two opposing ends thereof.

2. The toilet tank accessory rack according to claim 1, wherein the connecting plate has a hook formed on an end thereof for connecting to an opening in the toilet tank.

3. The toilet tank accessory rack according to claim 1, wherein the holding element has four inverted-L shaped clasps located on a back thereof, one of the four inverted-L shaped clasps engaging a corresponding one of the plurality of positioning notches located at each of two opposing ends of the two support plates of the fixing element.

4. The toilet tank accessory rack according to claim 1, wherein the holding element has a rectangular frame having a slot formed therein, the rectangular frame is configured to be located around the toilet tank with the toilet tank being located within the slot of the holding element, and the at least one storing chamber includes two storing chambers, one storing chamber of the two storing chambers is located on each of two opposing sides of the rectangular frame.

5. The toilet tank accessory rack according to claim 4, wherein each storing chamber is integrally formed with the rectangular frame and has a rectangular shape having an opening located in a top thereof.

6. The toilet tank accessory rack according to claim 4, wherein the rectangular frame has four inverted-L shaped clasps connected to fixing element.

7. The toilet tank accessory rack according to claim 4, further comprising art pictures located on a front and lateral sides of the rectangular frame corresponding to a front and lateral sides of the toilet tank, the art pictures are selected from a group consisting of flower patterns, animal pictures, and any combination thereof.

8. A toilet tank accessory rack for a toilet tank located adjacent to a wall comprising:

a fixing element configured to be connected to the wall; and a holding element connected to the fixing element and having at least one storing chamber, the holding element is configured to be located on four sides of the toilet tank, the at least one storing chamber is located on a side of the holding element, wherein the holding element has a rectangular frame having a slot formed therein, the rectangular frame is configured to be located around the toilet tank with the toilet tank being located within the slot of the holding element, and the at least one storing chamber includes two storing chambers, one storing chamber of the two storing chambers is located on each of two opposing sides of the rectangular frame, wherein the rectangular frame has four inverted-L shaped clasps connected to fixing element.

9. The toilet tank accessory rack according to claim 8, wherein each storing chamber is integrally formed with the rectangular frame and has a rectangular shape having an opening located in a top thereof.

10. The toilet tank accessory rack according to claim 8, further comprising art pictures located on a front and lateral sides of the rectangular frame corresponding to a front and lateral sides of the toilet tank, the art pictures are selected from a group consisting of flower patterns, animal pictures, and any combination thereof.

* * * * *